US010232612B2

(12) United States Patent
Iijima et al.

(10) Patent No.: US 10,232,612 B2
(45) Date of Patent: Mar. 19, 2019

(54) LIQUID JETTING DEVICE

(71) Applicant: TOSHIBA TEC KABUSHIKI KAISHA, Tokyo (JP)

(72) Inventors: Tomomi Iijima, Mishima Shizuoka (JP); Tomoki Hoshino, Mishima Shizuoka (JP); Keizaburou Yamamoto, Sunto Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/694,927

(22) Filed: Sep. 4, 2017

(65) Prior Publication Data

US 2018/0147845 A1 May 31, 2018

(30) Foreign Application Priority Data

Nov. 25, 2016 (JP) ..... 2016-229043

(51) Int. Cl.
*B41J 2/14* (2006.01)
*B41J 2/03* (2006.01)
*B41J 2/045* (2006.01)

(52) U.S. Cl.
CPC ..... *B41J 2/14056* (2013.01); *B41J 2/03* (2013.01); *B41J 2/04533* (2013.01); *B41J 2/14209* (2013.01); *B41J 2/04563* (2013.01); *B41J 2002/14362* (2013.01); *B41J 2002/14411* (2013.01); *B41J 2002/14491* (2013.01); *B41J 2202/08* (2013.01); *B41J 2202/12* (2013.01)

(58) Field of Classification Search
None
See application file for complete search history.

(56) References Cited

U.S. PATENT DOCUMENTS 6,260,951 B1 * 7/2001 Harvey ..... B41J 2/155 347/49
9,511,586 B2 12/2016 Iijima
2005/0185019 A1 * 8/2005 Goto ..... B41J 2/1609 347/47

(Continued)

FOREIGN PATENT DOCUMENTS

JP 2016-060153 4/2016

*Primary Examiner* — Erica Lin
(74) *Attorney, Agent, or Firm* — Kim & Stewart LLP

(57) ABSTRACT

A liquid jetting device includes a plurality of nozzles from which a liquid can be ejected, a plurality of pressure chambers, each being in fluid communication with an associated nozzle in the plurality of nozzles, actuators associated with each pressure chamber and configured to cause a pressure change in an associated pressure chamber in the plurality of pressure chambers, a heat-conductive chassis to which the plurality of nozzles, the plurality of pressure chambers, and the actuators are mounted, an integrated circuit held inside the chassis and configured to drive the actuators to eject liquid from the plurality of nozzles, a circuit board electrically connected to the integrated circuit and configured supply an electrical signal to integrated circuit, and a heat-conductive support to which the circuit board is mounted, the heat-conductive support held by the heat-conductive chassis to contact the integrated circuit and an inner surface of the heat-conductive chassis.

20 Claims, 13 Drawing Sheets

(56) References Cited

U.S. PATENT DOCUMENTS

| | | | | |
|---|---|---|---|---|
| 2005/0219325 | A1* | 10/2005 | Sugahara | B41J 2/14233 347/58 |
| 2007/0120888 | A1* | 5/2007 | Takata | B41J 2/1408 347/43 |
| 2011/0242155 | A1* | 10/2011 | Bansyo | B41J 2/175 347/6 |
| 2015/0243609 | A1* | 8/2015 | Lamorey | H01L 23/642 361/717 |

* cited by examiner

LIQUID JETTING DEVICE

CROSS-REFERENCE TO RELATED APPLICATION

This application is based upon and claims the benefit of priority from Japanese Patent Application No. 2016-229043, filed Nov. 25, 2016, the entire contents of which are incorporated herein by reference.

FIELD

Embodiments described herein relate generally to a liquid jetting device and a liquid jetting recording apparatus equipped with the liquid jetting device.

BACKGROUND

An apparatus for supplying minute liquid droplets in a designated amount at a designated location is known. For example, an inkjet printer dispenses ink droplets at specified positions on a recording medium, such as paper, to form images or characters. Inkjet printers include an inkjet head which ejects the ink droplets according to an image signal. In another example, a liquid dispensing apparatus supplies a reagent for pharmaceutical and biological research and development or medical diagnosis and examination in a predetermined amount into a predetermined container. Additionally, a three-dimensional (3D) printer somewhat similarly supplies a liquid resin in a predetermined amount at a predetermined location at predetermined time so as to perform 3D printing. The inkjet printer, the dispensing apparatus, and the 3D printer can each be equipped with a liquid jetting device which ejects minute liquid droplets according to control data. An inkjet head is an example of a liquid jetting device.

A known inkjet head includes a piezoelectric body having a groove serving as an ink flow path, an electrode formed in the groove, and a nozzle plate having nozzles from which ink can be ejected. A plurality of such grooves is formed and an electrode is formed inside each groove. A piezoelectric body between two adjacent grooves operates as a piezoelectric element supplying pressure on ink in the ink flow path. Adjacent piezoelectric elements are driven at a same time so as to expand or contract the volume of the ink flow path. By expansion and contraction of the ink flow path, ink in the ink flow path can be ejected from the nozzle. The piezoelectric elements are driven by an integrated circuit. However, repeated ink ejections cause the integrated circuit to generate heat.

If the temperature of the integrated circuit rises too high, the integrated circuit may be damaged.

DETAILED DESCRIPTION

Figure 1:
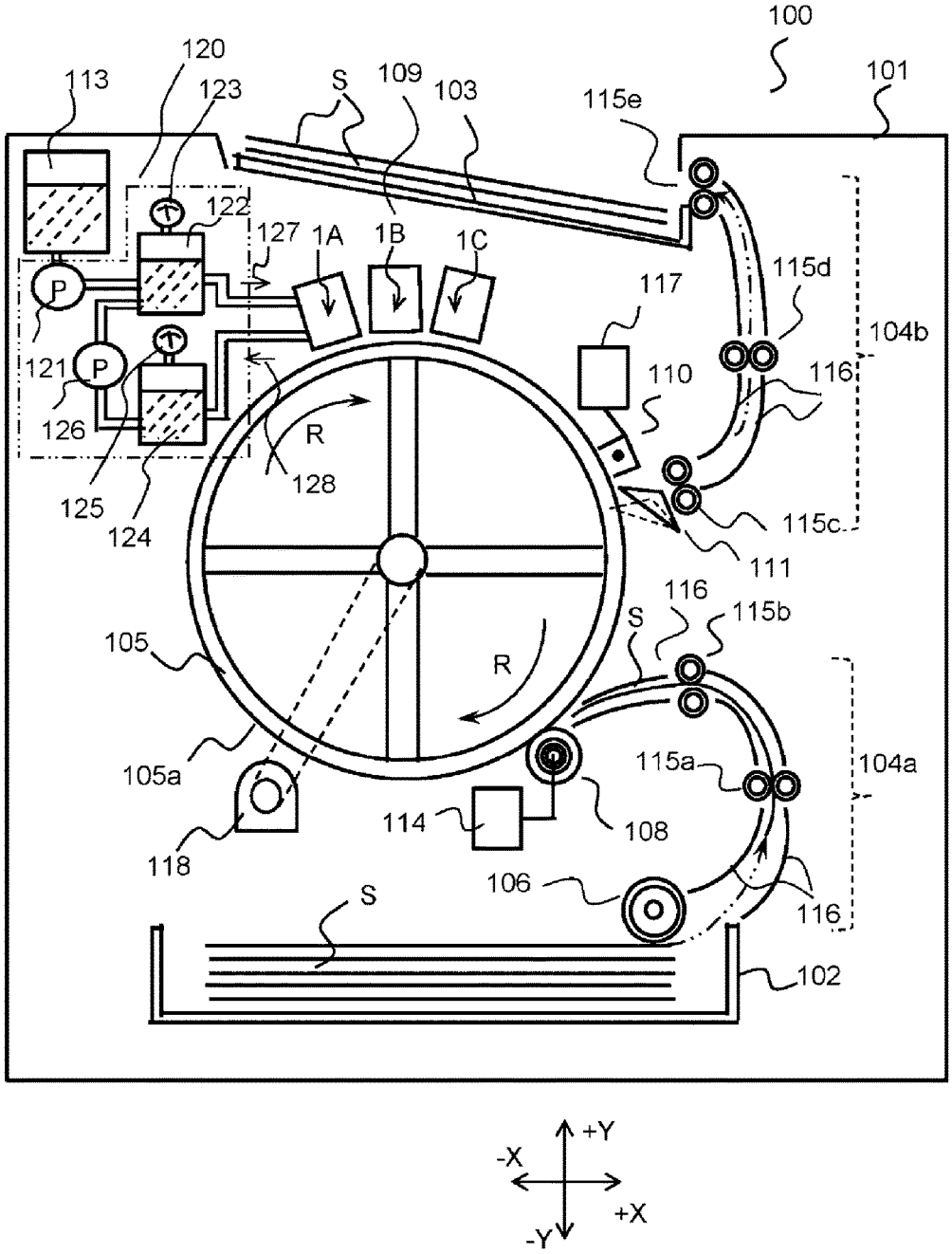
FIG. 1 is a schematic side view of an inkjet printer according to a first embodiment.

In general, a liquid jetting device includes a plurality of nozzles from which a liquid can be ejected, a plurality of pressure chambers, each pressure chamber being in fluid communication with an associated nozzle in the plurality of nozzles, actuators associated with each pressure chamber and configured to cause a pressure change in an associated pressure chamber in the plurality of pressure chambers, a heat-conductive chassis to which the plurality of nozzles, the plurality of pressure chambers, and the actuators are mounted, an integrated circuit held inside the chassis and configured to drive the actuators to eject liquid from the plurality of nozzles, a circuit board electrically connected to the integrated circuit and configured supply an electrical signal to integrated circuit, and a heat-conductive support to which the circuit board is mounted, the heat-conductive support held by the heat-conductive chassis to contact the integrated circuit and an inner surface of the heat-conductive chassis.

Hereinafter, various example embodiments will be described with reference to the drawings. The respective same reference numerals in the drawings denote the respective same members or portions.

An inkjet head ejects ink droplets toward a recording medium. Most ink droplets adhere onto the recording medium. However, trailing ink droplets, which are usually very small, may follow the primary ink droplets. These trailing ink droplets may form ink mists. The ink mists scatter and may adhere to the inkjet head or other locations inside an inkjet recording apparatus. Ink mists may adhere to an integrated circuit driving the piezoelectric actuators or to a circuit board sending signals to the integrated circuit in the inkjet head. If the ink is aqueous, then the ink mist might cause or promote short circuits. When a reagent being ejected includes an acid component or alkaline component, mists of such components may adhere to the integrated circuit or the circuit board, and cause corrosive malfunctions.

To prevent ink mists from adhering to an integrated circuit or a circuit board, the integrated circuit or the circuit board may be hermetically sealed with a chassis. Due to hermetic sealing, heat generated by the integrated circuit is retained within the chassis. Thus, the temperature of the sealed integrated circuit can increase, also causing malfunctions. Therefore, it is preferable to dissipate the heat generated by the integrated circuit to the exterior of the chassis.

A recording medium S is, for example, plain paper, art paper, or coated paper. Examples of the recording medium S other than paper include cloth, vinyl chloride resin film, plastic film, and ceramics.

Ink is a liquid in which a dye or a pigment, serving as colorant, is dissolved or dispersed in a solvent. Examples of the ink solvent include water, aqueous solvents, non-aqueous solvents, oil-based solvents, and mixed solvents. Furthermore, the meaning of "ink" in this context also includes transparent liquids (e.g., liquids lacking dye or pigment) which can be ejected from a liquid jetting device ejects. The transparent liquid can be used to form a base layer or a protective layer in image formation. The base layer is formed on the recording medium before an ink containing colorant to improve adhesion of the ink containing colorant, thus improving color development for ink adhering to the recording medium. The protective layer is formed over an already deposited ink layer. Examples of liquids which the liquid jetting device may eject also include reagents for pharmaceutical and biological research and development or medical diagnosis and examination, and liquid resins to be used by a 3D printer.

An inkjet head is illustrated as one example of a liquid jetting device. An inkjet printer is illustrated as one example of a liquid jetting recording apparatus that can be equipped with the liquid jetting device.

FIRST EMBODIMENT

FIG. 1 illustrates a cross-section of an inkjet printer 100 which is equipped with inkjet heads, 1A, 1B, and 1C, according to the first embodiment. A printing unit 109 includes the inkjet heads, 1A, 1B, and 1C. The inkjet head 1A ejects cyan ink and magenta ink. The inkjet head 1B ejects yellow ink and transparent ink. The inkjet head 1C ejects black ink. The inkjet heads 1A to 1C record an image on a recording medium S (e.g., sheet of paper) according to an image signal input from outside the inkjet printer 100. The detailed structure of each inkjet head is described below.

The inkjet printer 100 includes a box-shaped chassis 101. A sheet feed cassette 102, an upstream conveyance path 104*a*, a holding drum 105, a printing unit 109, a downstream conveyance path 104*b*, and a sheet discharge tray 103 are arranged from the lower portion to the upper portion in the Y-axis direction inside the chassis 101. The sheet feed cassette 102 contains sheets S to be used for printing by the inkjet printer 100. The inkjet heads 1A to 1C of the printing unit 109 are portions which eject ink droplets to the sheet S held on the holding drum 105 to record an image.

The sheet feed cassette 102, which contains sheets S, is provided at the lower portion of the chassis 101. A sheet feed roller 106 sends sheets S on one sheet at a time from the sheet feed cassette 102 to the upstream conveyance path 104*a*. The upstream conveyance path 104*a* includes sending roller pairs 115*a* and 115*b* and sheet guide plates 116, which regulate the conveyance direction of the sheet S. The sheet S is conveyed by the rotation of the sending roller pairs 115*a* and 115*b*, and, after passing through the sending roller pair 115*b*, is sent to the outer circumferential surface of the holding drum 105 along the sheet guide plates 116. The dashed-line arrows in FIG. 1 indicate a guided pathway of the sheet S.

The holding drum 105 is a cylinder made of aluminum having a thin insulating layer 105*a* of resin on the surface thereof. The circumferential length of the cylinder is longer than a length of a sheet S on which an image is to be recorded, and the length in the axial direction of the cylinder is longer than a width of the sheet S. The holding drum 105 is configured to be rotated by a motor 118 at a predetermined circumferential velocity in the direction of the arrow R. While the insulating layer 105*a* of the holding drum 105 holds the sheet S electrostatically, the holding drum 105 rotates to convey the sheet S to the printing unit 109. A charging roller 108, which charges the insulating layer 105*a* with static electricity, is arranged in contact with and along the insulating layer 105*a*.

The charging roller 108 has a rotating shaft made of metal and a conductive rubber layer, which is arranged around the rotating shaft. The charging roller 108 is connected to a high-voltage generation circuit 114. The surface of the conductive rubber layer is in contact with the insulating layer 105*a* of the holding drum 105, and the charging roller 108 is driven by a motor to rotate in such a manner that the circumferential velocity of the charging roller 108 is equal to the circumferential velocity of the holding drum 105. The insulating layer 105*a* of the holding drum 105 and the conductive rubber layer of the charging roller 108 contact each other to form a nip. The sheet S is sent to the nip by the sending roller pair 115*b* and the sheet guide plates 116. A high voltage generated by the high-voltage generation circuit 114 is applied to the metal rotating shaft of the charging roller 108 immediately before the sheet S is conveyed to the nip. The insulating layer 105*a* is electrically charged by the high voltage, and the sheet S conveyed to the nip is also electrically charged and is then electrostatically attracted to the outer circumferential surface of the holding drum 105. The electrostatically attracted sheet S is sent to the printing unit 109 by the rotation of the holding drum 105.

The printing unit 109 is fixed to the inkjet printer 100 with the ink ejection surfaces of the inkjet heads 1A to 1C and separated from the outer circumferential surface of the holding drum 105 by 1 mm. Each of the inkjet heads 1A to 1C, which are arranged at intervals in the circumferential direction of the holding drum 105, is long in the axial direction of the holding drum 105, referred to as a main scanning direction, and short in the rotational direction of the holding drum 105, referred to as a sub scanning direction. Each of the inkjet heads 1A to 1C ejects part of the supplied ink for image formation from the nozzle, and discharges the remaining ink to outside of the inkjet head. The discharged ink is collected and is then re-supplied to the inkjet head. This is what is referred to as a circulation type inkjet head. The detailed structure of each of the inkjet heads 1A to 1C is described below. An ink tank 113 is an ink container which reserves cyan ink, referred to simply as ink. An ink circulation device 120 is arranged between the ink tank 113 and the inkjet head 1A.

The ink circulation device 120 includes an ink supply pump 121, a supplying ink tank 122, a first pressure regulation unit 123, a collecting ink tank 124, a second pressure regulation unit 125, and an ink collection pump 126. The ink is ejected from the inkjet head 1A according to an image signal. The ink supply pump 121 supplies ink corresponding to the amount of ejected ink from the ink tank 113 to the supplying ink tank 122. The supplying ink tank 122 reserves the ink and then supplies the ink to the inkjet head 1A through a flow path 127. The supplying ink tank 122 is provided with the first pressure regulation unit 123. The collecting ink tank 124 reserves ink discharged from the inkjet head 1A through a flow path 128. The collecting ink tank 124 is provided with the second pressure regulation unit 125. The ink collection pump 126 sends the ink reserved in the collecting ink tank 124 to the supplying ink tank 122. The inkjet head 1A ejects an ink droplet in the direction of the gravitational force parallel to the direction −Y. Therefore, to prevent ink from leaking from the inkjet head 1A during a waiting time, it is necessary to keep the inside of each nozzle of the inkjet head 1A at negative pressure with respect to the atmospheric pressure. The first pressure regulation unit 123 and the second pressure regulation unit 125 regulate the ink pressure to negative pressure with respect to the atmospheric pressure in such a manner that the ink supplied to the inkjet head 1A does not leak from each nozzle of the inkjet head 1A. The pressure of ink in the nozzle is set lower by 1 kPa than the atmospheric pressure. For each of magenta ink of the inkjet head 1A, yellow ink and transparent ink of the inkjet head 1B, and black ink of the inkjet head 1C, a similar ink tank 113 and a similar ink circulation device 120 are provided. In FIG. 1, the ink tanks 113 and the ink circulation devices 120 for other than cyan ink are omitted from illustration.

In the printing unit 109, the inkjet heads 1A to 1C eject ink on the sheet S to form an image. An image is recorded according to an image signal input from outside the inkjet printer 100. The inkjet head 1A ejects cyan ink to form a cyan image and ejects magenta ink to forma magenta image. Similarly, the inkjet head 1B ejects yellow ink and transparent ink. The inkjet head 1C ejects black ink. The inkjet heads 1A to 1C are configured to record the respective color images. The inkjet heads 1A to 1C have the same configuration except for colors of ink to be ejected.

The sheet S on which an image has been recorded by the printing unit 109 is conveyed to a destaticizing device 110 (which is, e.g., an electrostatic discharge device) and a separating claw 111. The destaticizing device 110 has a U-shaped cross section, and made of a tungsten wire extending in a stainless chassis the length of which is the same as the length in the axial direction of the holding drum 105. The destaticizing device 110 is located in such a manner that the opening of the U-shaped chassis faces the outer circumferential surface of the holding drum 105. A high-voltage generation circuit 117 generates a high voltage opposite in polarity to the voltage applied to the charging roller 108. When the leading end of the sheet S with recording completed arrives at below the destaticizing device 110 in the process of being conveyed, the high voltage generated by the high-voltage generation circuit 117 is applied between the chassis and the tungsten wire. Corona discharge occurs from the opening side of the destaticizing device 110 due to the high voltage, thus destaticizing the electrically-charged sheet S. The separating claw 111 is provided as to move between a contact position at which the claw tip is in contact with the outer circumferential surface of the holding drum 105 and a separation position at which the claw tip is away from the outer circumferential surface thereof. Typically, the separating claw 111 is held at the separation position. To separate the sheet S from the holding drum 105, the tip of the separating claw 111 contacts the outer circumferential surface of the holding drum 105 and then separates the leading end of the destaticized sheet S from the insulating layer 105*a*. After separating the leading end of the sheet S from the outer circumferential surface, the separating claw 111 is returned from the outer circumferential surface to the separation position.

The sheet S separated from the holding drum 105 is sent to a sending roller pair 115*c*. The downstream conveyance path 104*b* includes sending roller pairs 115*c*, 115*d*, and 115*e* and sheet guide plates 116, which regulate the conveyance direction of the sheet S. The sheet S is conveyed by the sending roller pairs 115*c*, 115*d*, and 115*e* along the dashed-line arrow illustrated in FIG. 1 and is thus discharged to the sheet discharge tray 103.

A configuration of the inkjet head 1A is described in detail. As described above, the inkjet heads 1B and 1C each have the same structure as that of the inkjet head 1A.

Figure 2:
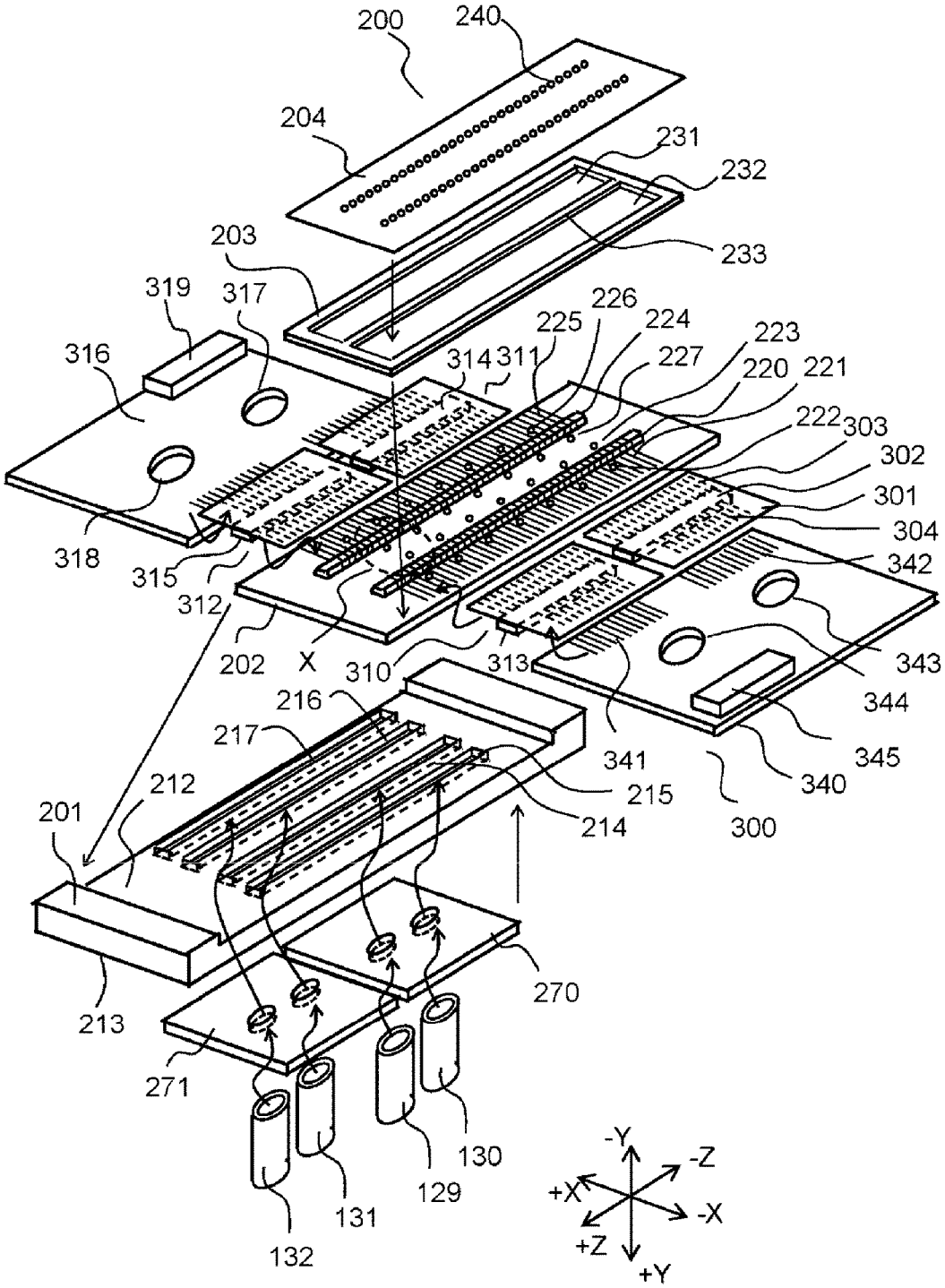
FIG. 2 is an exploded perspective view of an inkjet head according to the first embodiment.
Figure 3:
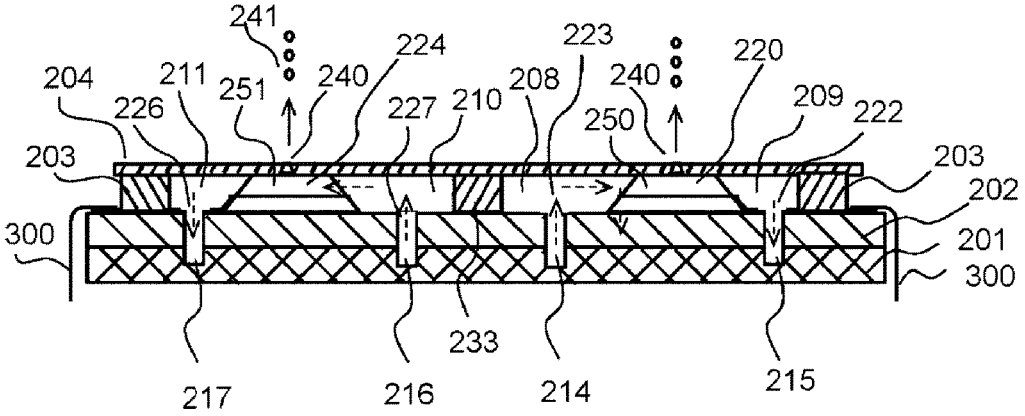
FIG. 3 is a cross-sectional view of an ink ejection portion of an inkjet head according to the first embodiment.
Figure 4A:
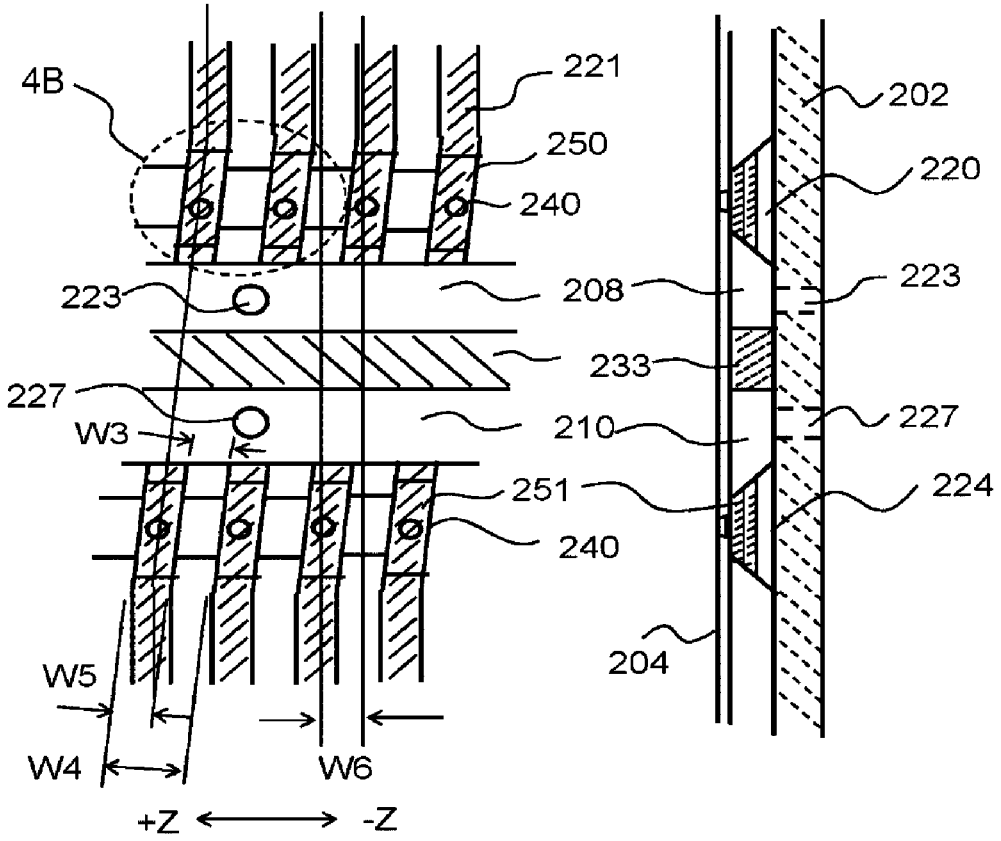
FIGS. 4A and 4B are enlarged views of an electrode portion of an inkjet head according to the first embodiment.
Figure 4B:
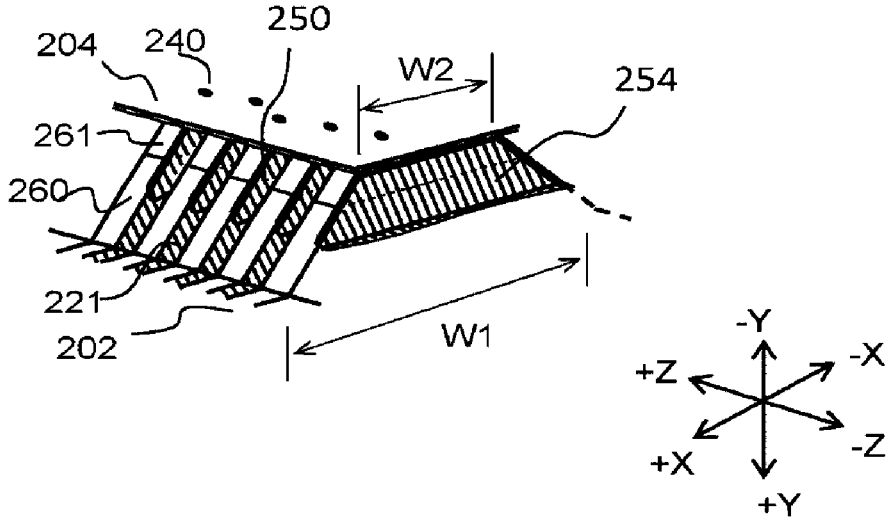

FIG. 2 is an exploded perspective view of an ink ejection portion 200 of the inkjet head 1A. FIG. 3 is a cross-sectional view of the ink ejection portion 200. FIG. 4A is an enlarged view of the portion X of the ink ejection portion 200 and illustrates a wiring pattern. FIG. 4B is a perspective view of pressure chambers.

The ink ejection portion 200 illustrated in FIG. 2 includes a nozzle plate 204, a frame 203, a substrate 202, a film 310 on which a drive integrated circuit (IC) is mounted, a circuit board 300, and a manifold 201.

The nozzle plate 204 has a plurality of nozzles 240 through which to eject ink droplets 241, as shown in FIG. 3. The nozzle plate 204 is made from a polyimide resin. The outer shape of the nozzle plate has a width of 16 mm in the X-axis direction, a length of 60 mm in the Z-axis direction, and a thickness of 50 μm in the Y-axis direction. The nozzles 240 with a diameter of 20 μm are arranged at pitches of 85 μm in two lines.

The frame 203 is made of stainless steel. The outer shape of the frame has a length of 60 mm, a width of 16 mm, and a thickness of 1 mm. Two openings with a length of 57 mm and a width of 6.25 mm are formed on the inner side of the frame 203. The outer circumference of the frame 203 has a width of 1.5 mm. A partition wall 233 with a width of 0.5 mm is provided at the middle of the frame 203. The partition wall 233 serves to form two rectangular openings 231 and 232. The frame 203 is sandwiched between the substrate 202 and the nozzle plate 204 and serves to prevent ink from leaking to the outside. The opening 231 serves as an ink chamber for a first ink, and the opening 232 serves as an ink chamber for a second ink. For example, the first ink is cyan ink, and the second ink is magenta ink. The openings 231 and 232 both serve as an ink chamber for black ink.

The substrate 202 is made from alumina ($Al_2O_3$). The outer shape of the substrate has a width of 20 mm, a length of 60 mm, and a thickness of 1 mm. The substrate 202 includes first ink supply ports 223, a first piezoelectric actuator row 220, first ink discharge ports 222, second ink supply ports 227, a second piezoelectric actuator row 224, and second ink discharge ports 226. The first piezoelectric actuator row 220 and the second piezoelectric actuator row 224 are each aligned in a line. The opening 232 of the frame 203 is fixed onto the substrate 202 so as to surround the first ink supply ports 223, the first piezoelectric actuator row 220, and the first ink discharge ports 222. The opening 231 of the frame 203 is fixed onto the substrate 202 so as to surround the second ink supply ports 227, the second piezoelectric actuator row 224, and the second ink discharge ports 226. The nozzle plate 204 is fixed by epoxy bonding agent to the frame 203 and the top portions of the first and second piezoelectric actuator rows 220 and 224.

Each of a plurality of first ink supply ports 223 and a plurality of first ink discharge ports 222 is arranged in a line in the Z-axis direction. The first piezoelectric actuator row 220 is located between the plurality of first ink supply ports 223 and the plurality of first ink discharge ports 222, each of which is arranged in a line. As illustrated in FIG. 3, a region surrounded by the substrate 202, the partition wall 233, the nozzle plate 204, and the first piezoelectric actuator row 220 serves as a first common ink supply chamber 208. A region surrounded by the substrate 202, the frame 203 of the opening 232, the nozzle plate 204, and the first piezoelectric actuator row 220 serves as a first common ink discharge chamber 209. The first ink supply ports 223 supply ink from the manifold 201 to the first common ink supply chamber 208. The first common ink supply chamber 208 supplies ink to a plurality of pressure chambers 250 formed in the first piezoelectric actuator row 220. The nozzle 240 is located at the central portion of each pressure chamber 250. Ink is supplied from the manifold 201 through the first ink supply ports 223, the first common ink supply chamber 208, the plurality of pressure chambers 250, the first common ink discharge chamber 209, and the first ink discharge ports 222 to the manifold 201, as indicated by the dashed-line arrow.

Referring back to FIG. 2, each of a plurality of second ink supply ports 227 and a plurality of second ink discharge ports 226 is arranged in a line in the Z-axis direction. The second piezoelectric actuator row 224 is located between the plurality of second ink supply ports 227 and the plurality of second ink discharge ports 226, each of which is arranged in a line. As illustrated in FIG. 3, a region surrounded by the substrate 202, the partition wall 233, the nozzle plate 204, and the second piezoelectric actuator row 224 serves as a second common ink supply chamber 210. A region surrounded by the substrate 202, the frame 203 of the opening 231, the nozzle plate 204, and the second piezoelectric actuator row 224 serves as a second common ink discharge chamber 211. The second ink supply ports 227 supply ink from the manifold 201 to the second common ink supply chamber 210. The second common ink supply chamber 210 supplies ink to a plurality of pressure chambers 251 formed in the second piezoelectric actuator row 224. The nozzle 240 is located at the central portion of each pressure chamber 251. A change in the volume of the pressure chamber 251 causes an ink droplet 241 to be ejected from the nozzle 240. Ink is supplied from the manifold 201 through the second ink supply ports 227, the second common ink supply chamber 210, the plurality of pressure chambers 251, the second common ink discharge chamber 211, and the second ink discharge ports 226 to the manifold 201, as indicated by the dashed-line arrow.

As illustrated in FIG. 2, the manifold 201 has an upper surface 212, onto which the substrate 202 is fixed, and a lower surface 213, which is opposite to the upper surface 212. The upper surface 212, onto which the substrate 202 is fixed, has a width of 20 mm in the X-axis direction and a length of 60 mm in the Z-axis direction. The manifold 201 is made from aluminum. The upper surface 212 has four long slots 214, 215, 216, and 217, formed therein in the Z-axis direction. A first connection member 270 and a second connection member 271 are arranged on the lower surface 213 of the manifold 201.

The long slot 214 communicates with the plurality of first ink supply ports 223. The first connection member 270 fluidly connects the long slot 214 with a first ink supply tube 129. The first ink supply tube 129 is connected to the flow path 127 fluidly connected with the ink circulation device 120. The long slot 215 is fluidly connected with the plurality of first ink discharge ports 222. The first connection member 270 fluidly connects the long slot 215 with a first ink discharge tube 130. The first ink discharge tube 130 is connected to the flow path 128 fluidly connected with the ink circulation device 120.

The long slot 216 is fluidly connected with the plurality of second ink supply ports 227. The second connection member 271 fluidly connects the long slot 216 with a second ink supply tube 131. The second ink supply tube 131 is connected to the flow path 127 fluidly connected with the ink circulation device 120. The long slot 217 is fluidly connected with the plurality of second ink discharge ports 226. The second connection member 271 fluidly connects the long slot 217 with a second ink discharge tube 132. The second ink discharge tube 132 is connected to the flow path 128 fluidly connected with the ink circulation device 120. The first ink supply tube 129 and the first ink discharge tube 130 are connected to the ink circulation device 120 for the first ink. The second ink supply tube 131 and the second ink discharge tube 132 are connected to the ink circulation device 120 for the second ink. In the inkjet head 1A, the first ink supply tube 129 and the first ink discharge tube 130 are connected to cyan ink, and the second ink supply tube 131 and the second ink discharge tube 132 are connected to magenta ink. In the inkjet head 1B, the first ink supply tube 129 and the first ink discharge tube 130 are connected to yellow ink, and the second ink supply tube 131 and the second ink discharge tube 132 are connected to transparent ink. In the inkjet head 1C, the first ink supply tube 129 and the first ink discharge tube 130 and the second ink supply tube 131 and the second ink discharge tube 132 are connected to black ink.

As illustrated in FIG. 3, the substrate 202, the frame 203, and the nozzle plate 204 are stacked and bonded onto the manifold 201 by epoxy bonding agent. The frame 203 is fixed to the substrate 202 in such a manner that the opening 232 surrounds the first piezoelectric actuator row 220 and the opening 231 surrounds the second piezoelectric actuator row 224.

Configurations of the first piezoelectric actuator row 220 and the second piezoelectric actuator row 224 are described. The first and second piezoelectric actuator rows 220 and 224 have the same configuration. FIG. 4A is an enlarged view of the portion X illustrated in FIG. 2. FIG. 4B is a perspective view of piezoelectric actuators 260 and 261, and the pressure chambers 250. The first and second piezoelectric actuator rows 220 and 224 have a plurality of piezoelectric actuators 260 and 261, illustrated in FIG. 4B and a plurality of pressure chambers 250 and 251 are arranged side by side.

The first and second piezoelectric actuator rows 220 and 224 have stacked piezoelectric bodies 260 and 261, each including a first piezoelectric body 260 and a second piezoelectric body 261. The first piezoelectric body 260 and the second piezoelectric body 261 are made from lead zirconate titanate (PZT). The first piezoelectric body 260 has a width of 3.5 mm, a length of 52 mm, and a thickness of 0.9 mm, and is polarized in the direction −Y. The second piezoelectric body 261 has a width of 3.5 mm, a length of 52 mm, and a thickness of 0.1 mm, and is polarized in the direction +Y. The directions of polarization of the first piezoelectric body 260 and the second piezoelectric body 261 are opposite to each other. The first piezoelectric body 260 and the second piezoelectric body 261 are bonded to each other by epoxy bonding agent and have a total thickness of 1 mm. The stacked piezoelectric bodies, 260 and 261, have slant surfaces with an angle (θ) of 45 degrees formed at both ends thereof along the X-axis direction. The slant surface extends from one end to the other end of the stacked piezoelectric bodies 260 and 261 along the Z-axis direction. Thus, the width W1 of the stacked piezoelectric bodies 260 and 261 on the side of the substrate 202 is 3.5 mm and the width W2 thereof on the side of the nozzle plate 204 is 1.5 mm.

The stacked piezoelectric bodies 260 and 261 have a plurality of grooves 254 formed so as to traverse the slant surfaces in the X-axis direction. The width W3 of the groove 254 is 0.04 mm. The grooves 254 are arranged with pitches W4 of 0.085 mm, at regular intervals in the Z-axis direction. The stacked piezoelectric bodies 260 and 261 with a width W5 function as a piezoelectric actuator. A portion corresponding to the groove 254 functions as the pressure chamber 250 or 251. A film-like electrode 221 formed on the inner surface of the groove 254 is drawn onto the slant surface of the stacked piezoelectric bodies 260 and 261 and the surface of the substrate 202. The groove 254 formed in the first and second piezoelectric actuator rows 220 and 224 extends over the first and second piezoelectric actuator rows 220 and 224 and is arranged to slightly incline, as illustrated in FIG. 4A. Therefore, the nozzles 240 and 241 respectively provided at the central portions of the pressure chambers 250 and 251 are separated from each other by W6 of 0.085 mm in the Z-axis direction.

The first piezoelectric actuator row 220 has 600 grooves 254 formed therein each forming the pressure chamber 250. The electrode 221 is formed on the inner surface of each groove 254. The electrode 221 in the groove 254 is connected to an extraction electrode 225 formed on the slant surface and the surface of the substrate 202. Since 600 pressure chambers 250 are formed in the first piezoelectric actuator row 220, 600 extraction electrodes 225 are formed on the substrate 202. Similarly, for the second piezoelectric actuator row 224, 600 extraction electrodes 225 are also formed on the substrate 202.

As illustrated in FIG. 2, 600 extraction electrodes 225 connected to the first piezoelectric actuator row 220 are electrically connected to the drive ICs 302 and 313. The drive IC 302 is directly provided on a substrate made from polyimide film. This is what is referred to as a Chip on Film (COF) 301. The film of the COF 301 is formed of a polyimide resin with a width of 25 mm in the Z-axis direction, a length of 20 mm in the X-axis direction, and a thickness of 25 μm. As illustrated in FIG. 5, electrodes 303 arranged at the same pitches as the pitches of the extraction electrodes 225 are formed on the film of the COF 301. The extraction electrodes 225 on the substrate 202 and the electrodes 303 on the COF 301 are electrically connected to each other by anisotropic conductive films 360, also referred to as anisotropic contact films (ACF). On the COF 301, 300 electrodes 303 are provided, and are connected to the drive IC 302. Signal lines 304 for activating the drive IC 302 are formed on the surface on which the electrodes 303 of the COF 301 and the drive IC 302 are provided. The drive IC 302, which is connected to 300 electrodes 303, has a rectangular shape with a length of 23 mm in the Z-axis direction, a length of 2 mm in the X-axis direction, and a thickness of 0.5 mm in the Y-axis direction. The drive IC 313 provided on the COF 310 is also connected to 300 extraction electrodes 225. The drive IC 313 also has a rectangular shape with a length of 23 mm in the Z-axis direction and a length of 2 mm in the X-axis direction. The drive ICs 302 and 313 are arranged side by side along the Z-axis direction. Thus, the drive ICs 302 and 313 are long in the Z-axis direction and short in the X-axis direction.

The second piezoelectric actuator row 224 is also formed in the same manner as in the first piezoelectric actuator row 220. On the substrate 202, 600 extraction electrodes 225 extending from the second piezoelectric actuator row 224 are formed. The 600 extraction electrodes 225 are connected to electrodes of two COFs 311 and 312. The electrodes of the COFs 311 and 312 are connected to drive ICs 314 and 315. The drive ICs 314 and 315 have the same configuration as that of the drive ICs 302 and 313.

Figure 5A:
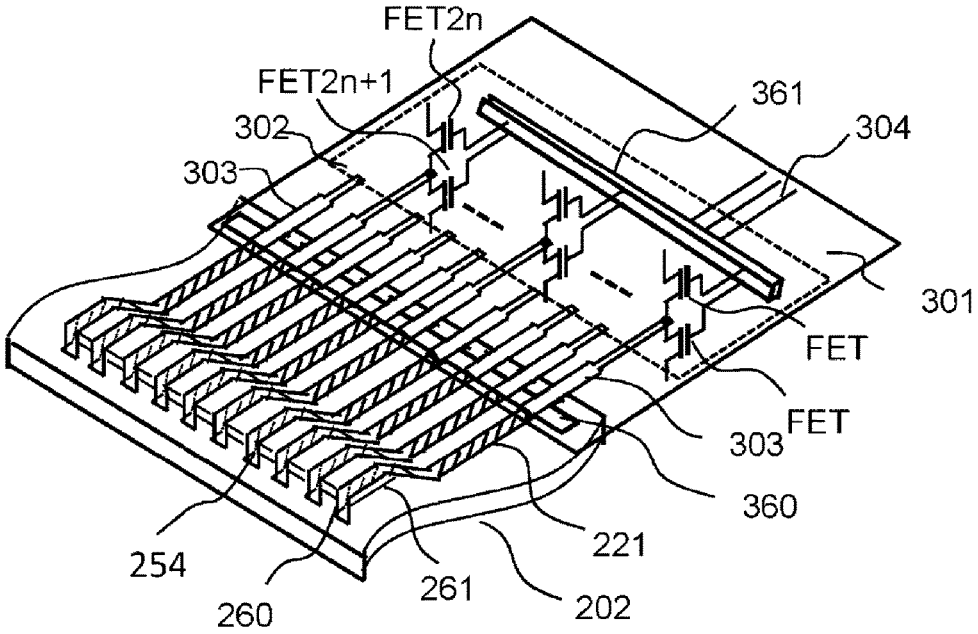
FIGS. 5A and 5B are diagrams of an integrated circuit mounted on an inkjet head according to the first embodiment.
Figure 5B:
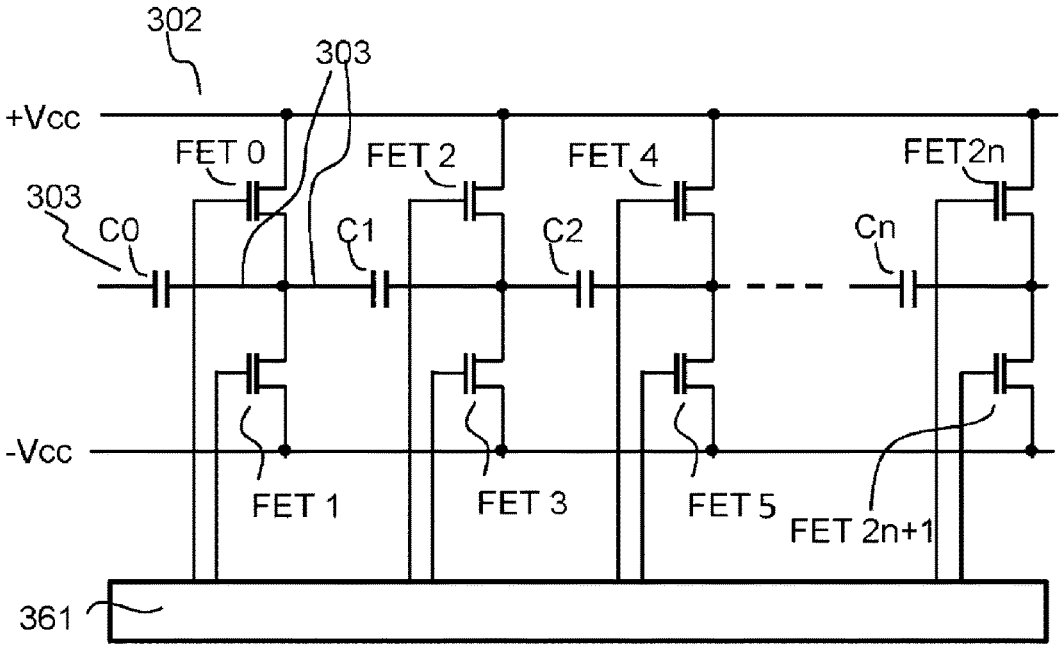

FIG. 5A illustrates the substrate 202, on which the extraction electrodes 225 are formed, and the COF 301, on which the drive IC 302 is mounted. The extraction electrode 225 is electrically connected to the electrode 221 formed on the inner surface of the groove 254. The extraction electrode 225 is electrically connected to the electrode 303 of the COF 301 via the ACF 360. The electrodes 303 are respectively connected to field effect transistors (FETs) of the drive IC 302. Two FETs are arranged in series, and a drain terminal of one FET is connected to a source terminal of the other FET. Each electrode pattern is connected to a connection portion between the drain terminal and the source terminal. FIG. 5B illustrates an equivalent circuit of the electrode 303 and the drive IC 302. FETs for driving are connected to the power supply voltages +VCC and −VCC. In each of the piezoelectric actuators 260 and 261, a PZT serves as dielectric and is sandwiched between two electrodes. Therefore, the piezoelectric actuators 260 and 261 are expressed as electrostatic capacitances (C0, C1, C2, . . . , Cn). In an example described below the capacitance C1 of the piezoelectric actuator 260 or 261 is driven. One extraction electrode 225 formed in one groove serves as a common electrode between the capacitances C0 and C1 of two adjacent piezoelectric actuators 260 and 261. Such one extraction electrode 225 is connected to an FET 0 and an FET 1 of the drive IC 302. An adjacent extraction electrode 225 connected to the capacitances C1 and C2 of the piezoelectric actuators 260 and 261 is connected to an FET 2 and an FET 3. When the FET 0 and the FET 3 are turned on and the FET 2 and the FET 1 are turned off, the capacitance C1 of the piezoelectric actuator 260 or 261 undergoes shear deformation to generate a pressure to ink in the pressure chamber 250. When the FET 2 and the FET 1 are turned on and the FET 0 and the FET 3 are turned off, the capacitance C1 of the piezoelectric actuator 260 or 261 undergoes shear deformation in a reverse direction to generate a pressure to ink in an adjacent pressure chamber 250. A selection circuit 361 activates the FET 0, FET 1 . . . FET 2*n*, FET 2*n*+1 at predetermined timing. The drive IC 302, which includes the selection circuit 361 and a plurality of FETs, is formed as an integrated circuit (IC). Driving two adjacent piezoelectric actuators 260 and 261 simultaneously expands or contracts the volume of the pressure chamber 250. Due to a change in the volume of the pressure chamber 250, an ink droplet 241 is ejected from the nozzle 240. To eject an ink droplet from one pressure chamber 250, six FETs are required.

300 electrodes 303 of the COF 301 are respectively connected to 600 extraction electrodes 225, which are arranged in a line, and the electrodes 303 are connected to FETs of the drive IC 302. Thus, the drive IC 302 has a rectangular shape long in the Z-axis direction.

Referring back to FIG. 2, the circuit board 300 is described. The circuit board 300 includes, for example, a signal generation circuit which drives the selection circuit 361 according to printing data input from outside of the inkjet heads 1A to 1C, power supply voltages +VCC and −VCC for FETs, and a temperature detection circuit. The circuit board 300 further includes a connector 345 mounted thereon, which receives signals to be input from the inkjet printer 100 to the inkjet heads 1A to 1C.

Figure 8:
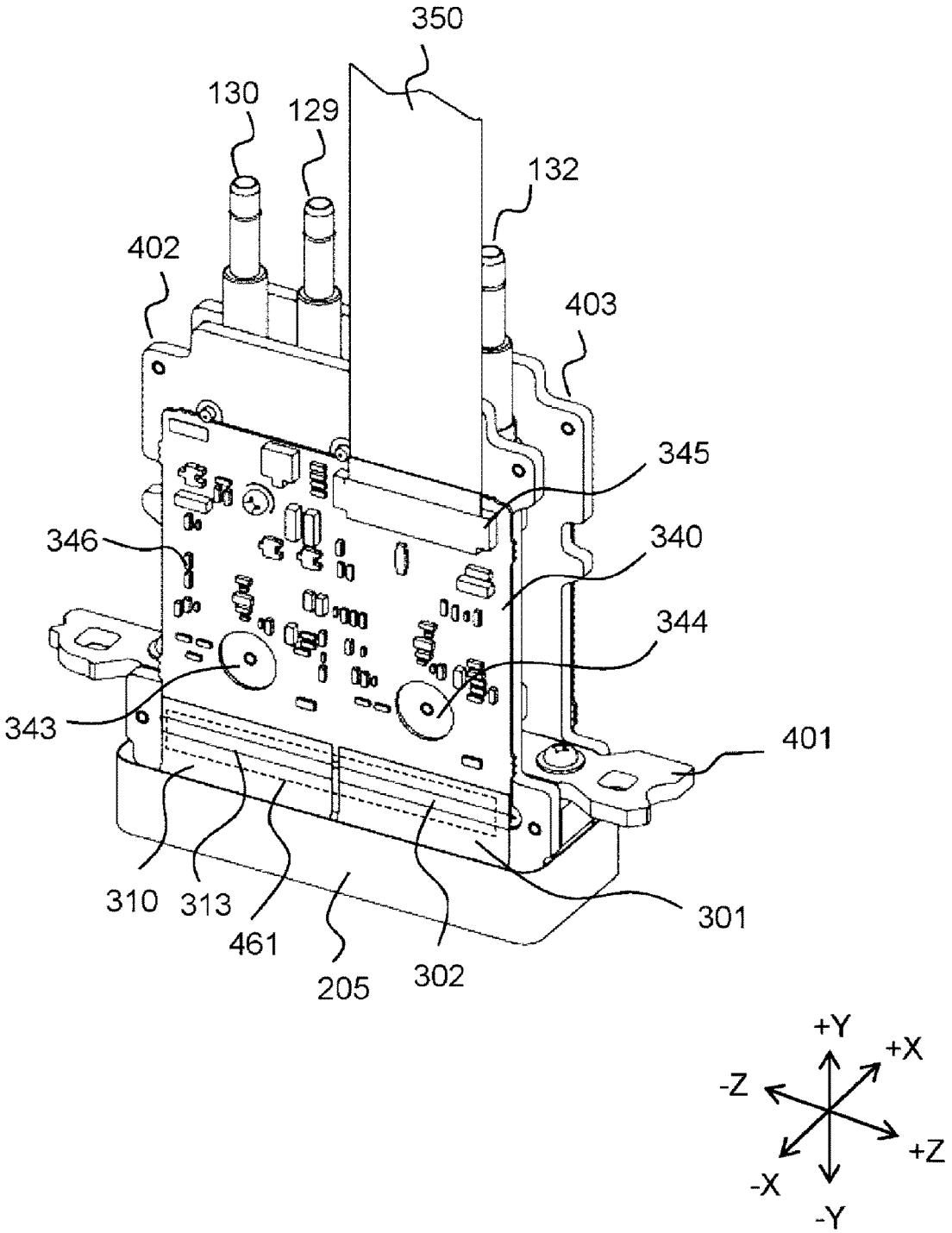
FIG. 8 is a diagram of first heat-conducting members, an ink ejection portion, an integrated circuit, and an circuit board mounted on an inkjet head according to the first embodiment.

The circuit board 300 includes a printed-wiring board 340, circuit components 346 as illustrated in FIG. 8, the connector 345, wiring lines 342 to be connected to the signal lines 304 of the COF 301, and wiring lines 341 to be connected to the signal lines 304 of the COF 310. The circuit components 346 include, for example, a signal generation circuit which drives the selection circuit 361, power supply voltages +VCC and −VCC for FETs, and a temperature detection circuit.

Figure 6:
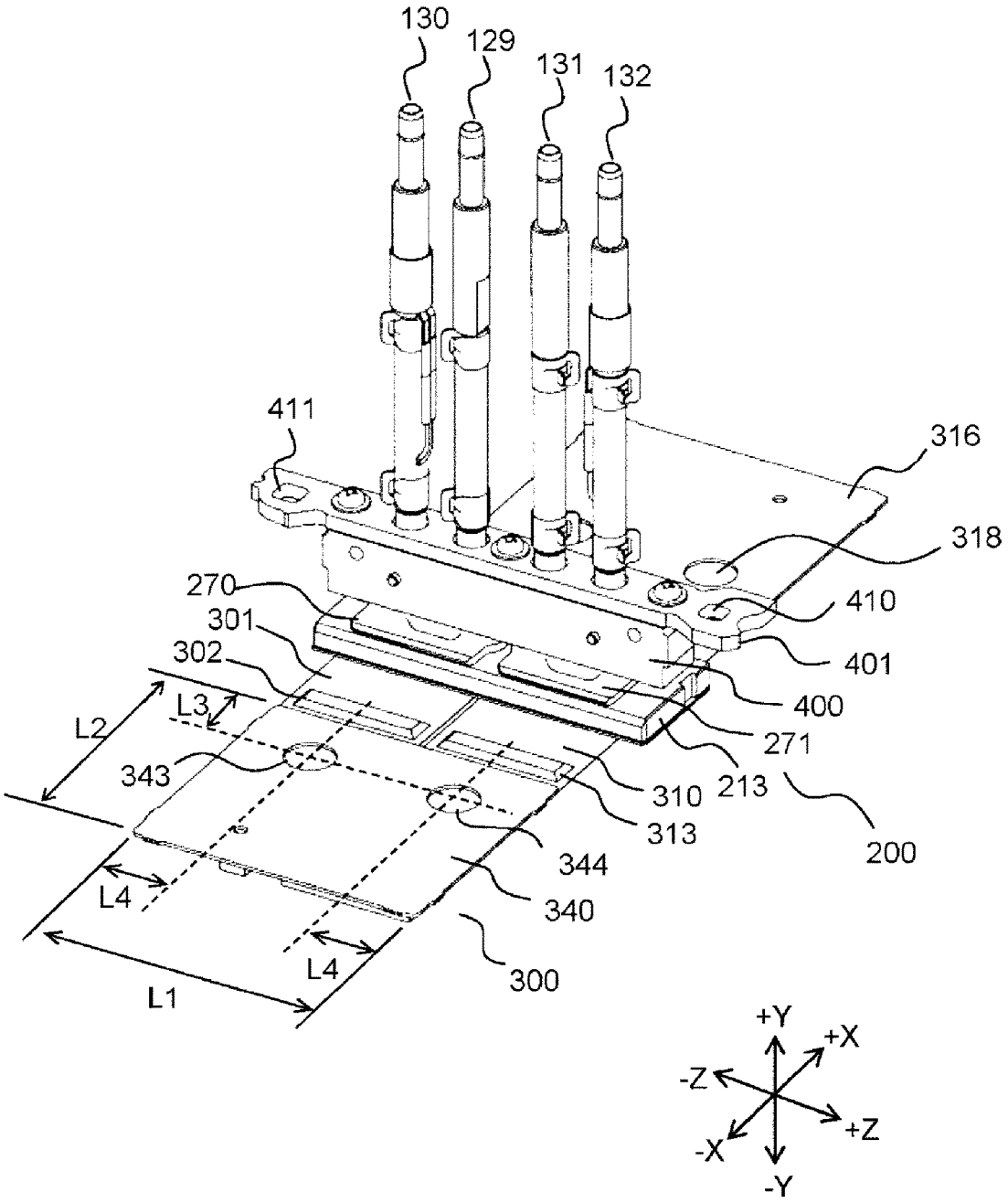
FIG. 6 is a development view of an ink ejection portion, an integrated circuit, and a circuit board which are mounted on an inkjet head according to the first embodiment.

The printed-wiring board 340 is a multi-layer glass epoxy substrate. The outer shape of the printed-wiring board 340 as shown in FIG. 6 has a length L1 of 55 mm in the Z-axis direction, a length L2 of 50 mm in the X-axis direction, and a thickness of 0.8 mm. Circuit wiring lines made of copper foil are formed on the surface and the inside of the printed-wiring board 340. The circuit wiring lines made of copper foil provide wiring connection to the circuit components 346. The wiring lines 342 for connection to the signal lines 304 of the COF 301 by the ACF are formed at one end portion of the printed-wiring board 340 in the X-axis direction. Similarly, the wiring lines 341 for connection to the signal lines 304 of the COF 310 are arranged adjacent to the wiring lines 342 in the Z-axis direction. Signals generated by the circuit components 346 are transmitted to the COFs 301 and 310 via the wiring lines 342 and 341 and the ACF. Two circular openings 343 and 344 with a diameter of 10 mm are formed in the printed-wiring board 340. The openings 343 and 344 are provided to dissipate heat generated by the drive ICs 302 and 313, as described below.

A printed-wiring board 316 has the same configuration as that of the printed-wiring board 340. The printed-wiring board 316 also has two openings 317 and 318 formed therein. Each of the openings 317 and 318 is a circular through-hole with a diameter of 10 mm. COFs 311 and 312 are connected to connection wiring lines of the printed-wiring board 316. The printed-wiring board 316 is provided with a connector 319 to be connected to the inkjet printer 100.

A configuration of the inkjet head 1A is described with reference to FIG. 6 to FIGS. 11A and 11B. FIG. 6 to FIG. 10 are development views illustrating the process of assembling the inkjet head 1A. FIG. 11A is an external view of the inkjet head 1A. FIG. 11B is a cross-sectional view of the inkjet head 1A.

Referring to FIG. 6, a fixing member 400 serves to fix the first ink supply tube 129, the first ink discharge tube 130, the second ink supply tube 131, and the second ink discharge tube 132 to the ink ejection portion 200. A supporting member 401, which serves to fix the inkjet head 1A to the inkjet printer 100, is fixed to the fixing member 400. Quadrangular openings 410 and 411 are provided in the supporting member 401. The inkjet head 1A is screwed to a predetermined position in the inkjet printer 100 via the quadrangular openings 410 and 411. Each of the fixing member 400 and the supporting member 401 is made from stainless steel.

Each of the openings 343 and 344 of the printed-wiring board 340 is a circular through-hole with a diameter of 10 mm. L3 denotes a distance from the end portion of the printed-wiring board 340 in the vicinity of the drive ICs 302 and 313 to the center of the opening 343 or 344. The distance L3 is 12 mm. L4 denotes a distance from both end portions of the printed-wiring board 340 in the Z-axis direction to the respective centers of the openings 343 and 344. The distance L4 is 13 mm. The printed-wiring board 316 also has openings 317 and 318 formed therein as with the printed-wiring board 340. The centers of the openings 343 and 344 are located at respective positions which are almost on the lines passing through the centers of the drive ICs 302 and 313 in the Z-axis direction and which are near the drive ICs 302 and 313.

Figure 7:
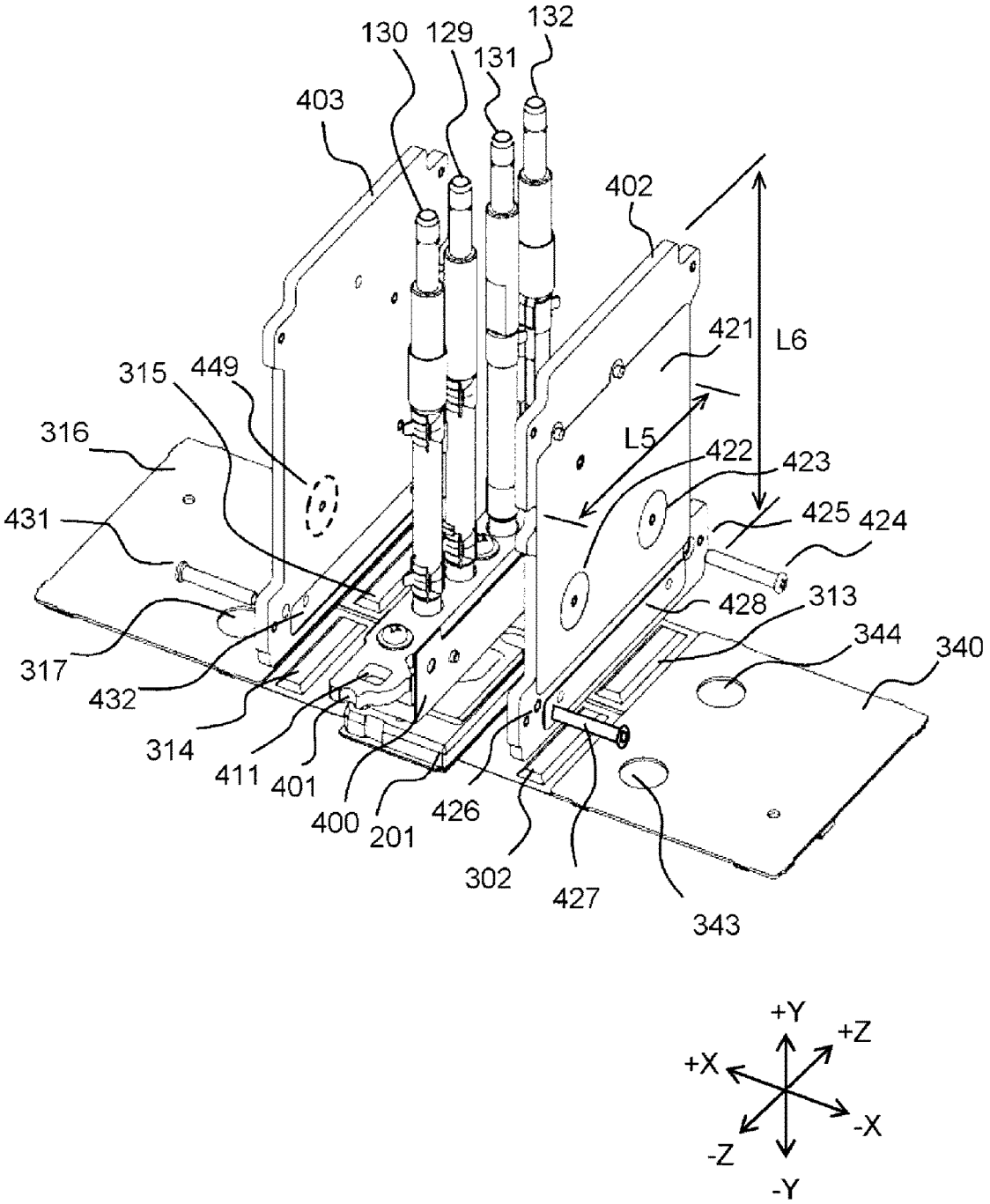
FIG. 7 is a diagram of first heat-conducting members mounted on an inkjet head according to the first embodiment.

FIG. 7 illustrates a first heat-conducting member 402, which supports the printed-wiring board 340 and the drive ICs 302 and 313. The outer shape of the first heat-conducting member 402 has approximately a length L5 of 55 mm in the Z-axis direction, a length L6 of 70 mm in the Y-axis direction, and a thickness of 1.5 mm. The material of the first heat-conducting member 402 is pure aluminum. The first heat-conducting member 402 is provided with fixing screw holes 425 and 426 at the end portions thereof in the Z-axis direction. Screws 424 and 427 are threaded into the screw holes 425 and 426, respectively, to fix the first heat-conducting member 402 to the fixing member 400. The first heat-conducting member 402 has a raised flat surface 428 with a length of 55 mm in the Z-axis direction and a length of 4 mm in the Y-axis direction. The raised flat surface 428 is embossed and formed on the first heat-conducting member 402. The height of the raised portion is 0.3 mm. The first heat-conducting member 402 supports the printed-wiring board 340 and further conducts heat generated by the drive ICs 302 and 313. A polyethylene terephthalate (PET) film 421 with a thickness of 0.05 mm is fixed to the surface of the first heat-conducting member 402. The PET film 421 is provided to insulate the printed-wiring board 340 from the first heat-conducting member 402 made of pure aluminum. The PET film 421 has openings 422 and 423 with a diameter of 10 mm at respective positions which correspond to the openings 343 and 344 of the printed-wiring board 340, as described below.

A second heat-conducting member 403 has the same configuration as that of the first heat-conducting member 402. The second heat-conducting member 403 has a raised flat surface 432 having the same shape as that of the raised flat surface 428. The first heat-conducting member 403 has a PET film having an opening 449 with a diameter of 10 mm. The opening 449 is provided at a position corresponding to the opening 317 of the printed-wiring board 316. Although not illustrated in FIG. 7, the PET film has an opening 450 with a diameter of 10 mm at a position corresponding to the opening 318 of the printed-wiring board 316.

FIG. 8 illustrates a configuration in which the COFs 301 and 310 are bent almost at a right angle toward the direction +Y along the manifold 201 and the printed-wiring board 340 is fixed to the first heat-conducting member 402 in parallel therewith. The printed-wiring board 316 is also fixed to the first heat-conducting member 403 in parallel therewith. Since the COFs 301 and 310 are bent almost at the right angle, the upper surfaces of the drive ICs 302 and 313 mounted on the COFs 301 and 310 contact the raised flat surface 428 of the first heat-conducting member 402. To electrically insulate the drive ICs 302 and 313, the raised flat surface 428 and the upper surfaces of the drive ICs 302 and 313 are in contact with each other via a PET film 461 with a thickness of 0.03 mm interposed therebetween as illustrated in FIG. 11B. The PET film 461 has a thickness so as not to hinder heat transfer from the drive ICs 302 and 313 to the raised flat surface 428. The COFs 301, 310, 311, and 312, which are connected to the substrate 202, are covered with a stainless-steel cover 205. The stainless-steel cover 205 is made of a stainless steel with a thickness of 0.1 mm. The stainless-steel cover 205 has an exposed portion at a region in which the nozzles 240 are formed. Ink droplets 241 are ejected from the nozzles 240 through the exposed portion. A signal cable 350 extending from the inkjet printer 100 is inserted into the connector 345. An input signal from the inkjet printer 100 is input to the printed-wiring board 340 via the signal cable 350.

Figure 9:
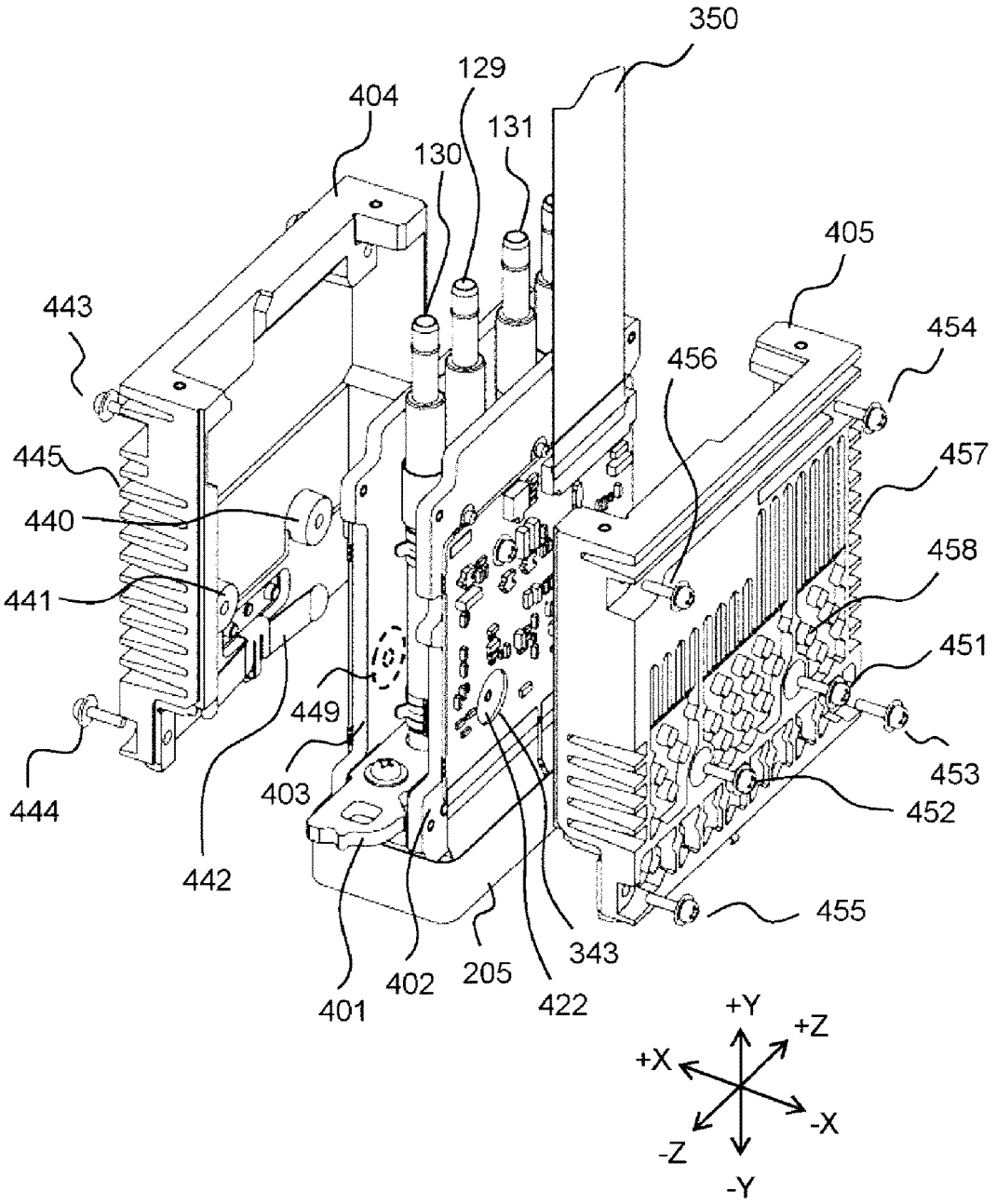
FIG. 9 is a diagram of second heat-conducting members, also serving as a chassis, mounted on an inkjet head according to the first embodiment illustrated in FIG. 8.

FIG. 9 illustrates second heat-conducting members 404 and 405. FIG. 9 also illustrates the process of incorporating the second heat-conducting members 404 and 405 with the inkjet head 1A having the configuration illustrated in FIG. 8.

The second heat-conducting member 404 is described. The second heat-conducting members 404 and 405 have the same configuration. The second heat-conducting members 404 and 405 also serve as a chassis of the inkjet head 1A. The second heat-conducting member 404 is made of die-cast aluminum. The inner surface, facing the printed-wiring board 316, of the second heat-conducting member 404 includes two circular projections 440 and 441. Each of the circular projections 440 and 441 has a diameter of 9.5 mm and has a height so as to contact the surface of the first heat-conducting member 403 when the second heat-conducting member 404 is incorporated with the first heat-conducting member 403. The circular projection 440 contacts the first heat-conducting member 403 through the opening 450 of the PET film and the opening 318 of the printed-wiring board 316. The circular projection 441 contacts the first heat-conducting member 403 through the opening 449 of the PET film and the opening 317 of the printed-wiring board 316. Each of the circular projections 440 and 441 has an opening, into which a screw is threaded, at a central portion thereof and is thus fixed to the first heat-conducting member 403. The second heat-conducting member 404 is provided with a leaf spring 442 at the inner surface thereof. When the second heat-conducting member 404 is fixed to the first heat-conducting member 403, the leaf spring 442 presses the drive IC 314 of the COF 311 and the drive IC 315 of the COF 312 against the raised flat surface 432 of the first heat-conducting member 403. The outer surface of the second heat-conducting member 404 is provided with a large number of projections 445 for heat dissipation. The projections 445 dissipate heat from the second heat-conducting member 404.

The second heat-conducting member 405 also has the same configuration as that of the second heat-conducting member 404. The second heat-conducting members 404 and 405 are fixed to the first heat-conducting members 403 and 402, respectively, with screws 443, 444, 451, 452, 453, 454, 455, and 456, as illustrated in FIG. 9.

Figure 10:
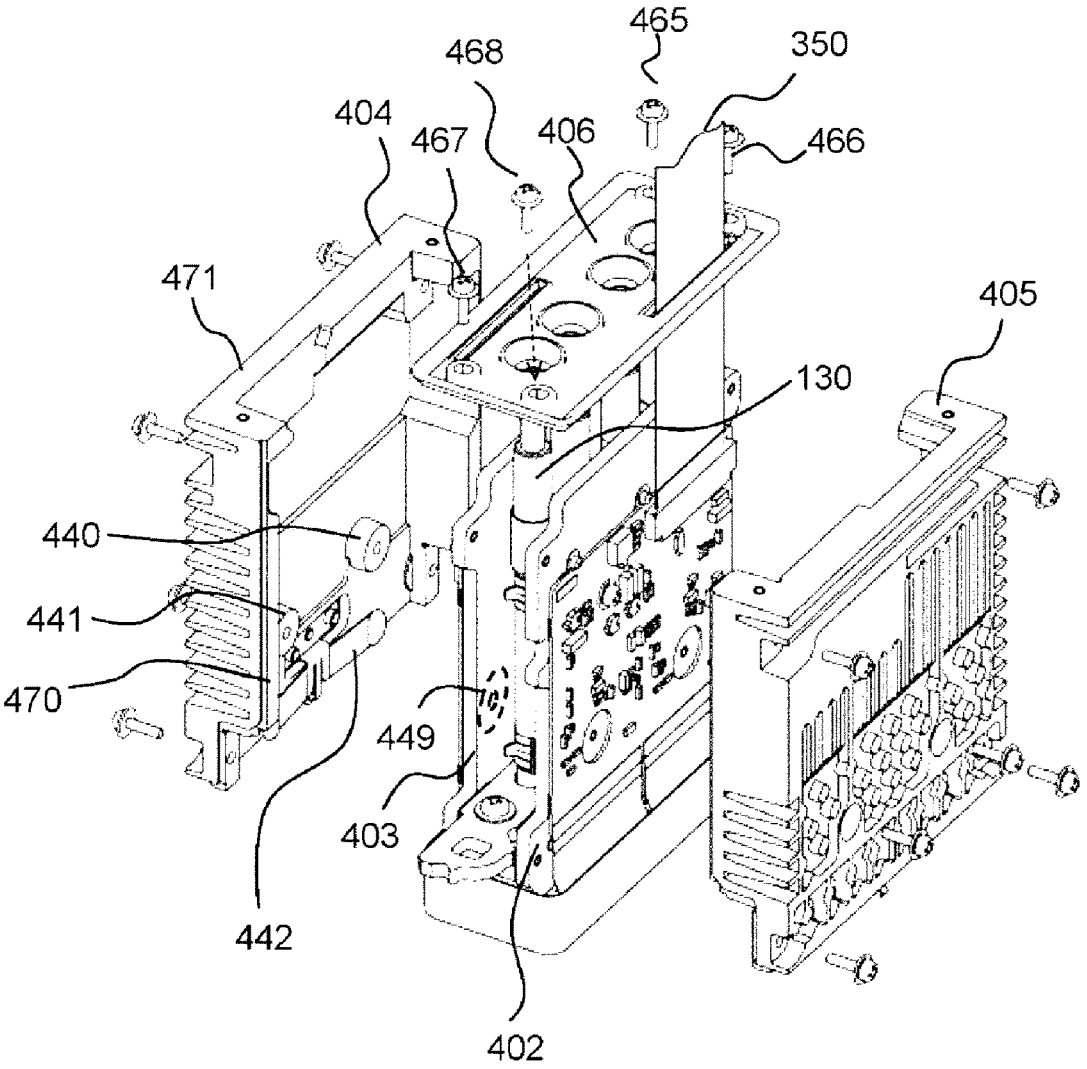
FIG. 10 is a diagram of an upper-surface cover of an inkjet head according to the first embodiment illustrated in FIG. 9.
Figure 11A:
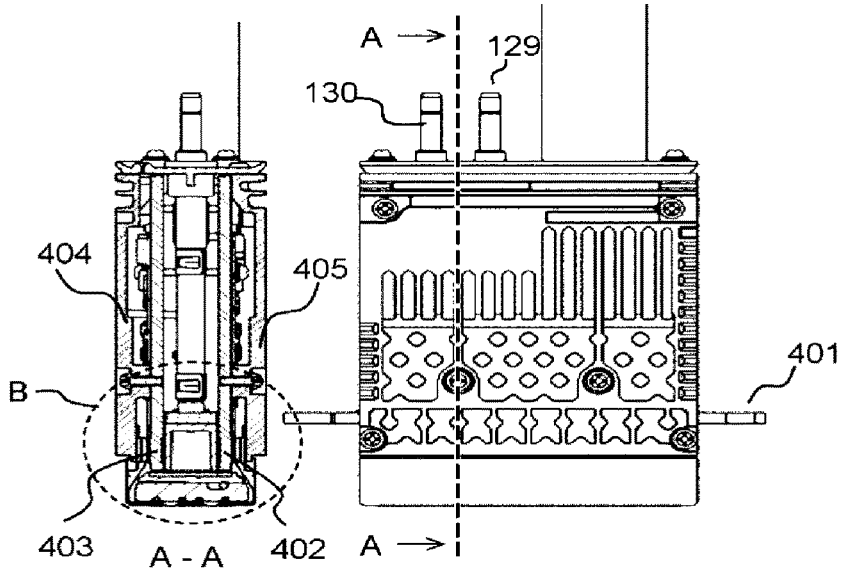
FIGS. 11A and 11B are a plan view and a cross-sectional view of an inkjet head according to the first embodiment.
Figure 11B:
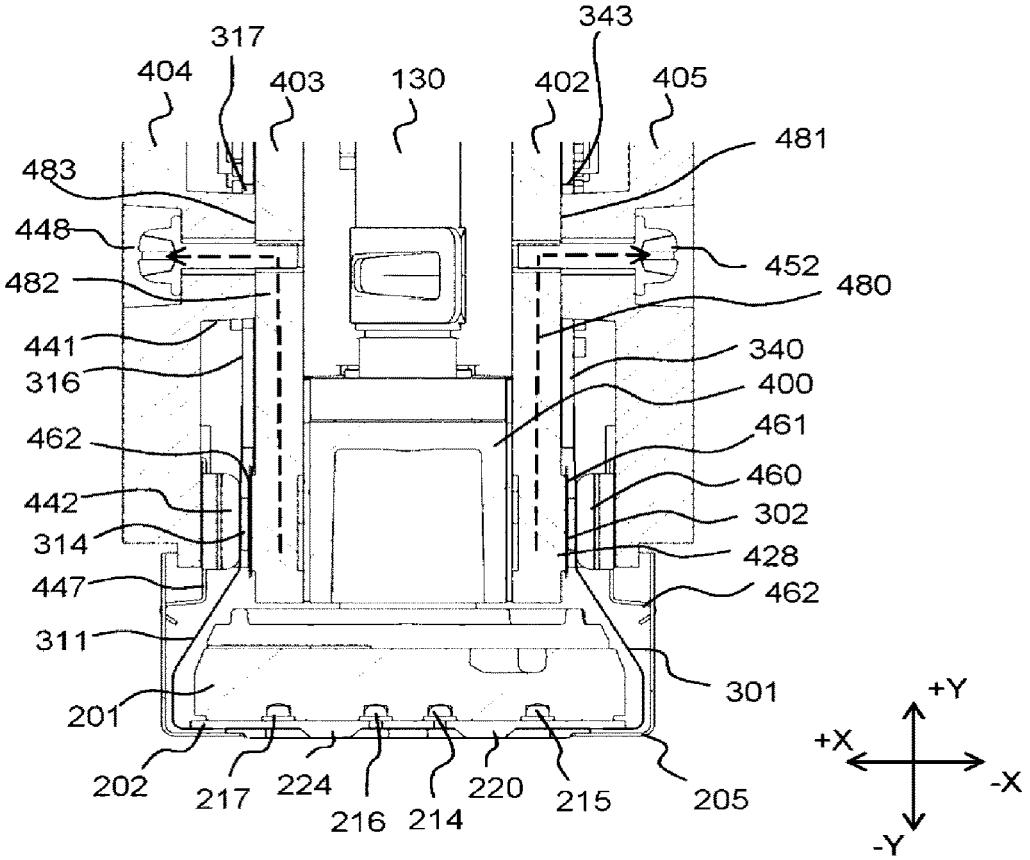

FIG. 10 illustrates the process of incorporating an upper-surface cover 406. The upper-surface cover 406 is fixed to the second heat-conducting members 404 and 405 with screws 465, 466, 467, and 468. During such fixing, the cable 350 connected to the connector 345, a signal cable, not illustrated in FIG. 10, connected to the connector 319, the first ink supply tube 129, the first ink discharge tube 130, the second ink supply tube 131, and the second ink discharge tube 132 pass through the upper-surface cover 406. After completion of assembly, a boundary portion 470 between the second heat-conducting members 404 and 405 and a boundary portion 471 between the upper-surface cover 406 and the second heat-conducting members 404 and 405 are sealed with epoxy resin.

FIG. 11A illustrates a plan view and a cross-sectional view taken along the line A-A of the inkjet head 1A. FIG. 11B is an enlarged view of a portion B illustrated in FIG. 11.

As illustrated in FIG. 11B, the COF 301 is connected to the first piezoelectric actuator row 220 via the ACF 360. The drive IC 302 of the COF 301 is pressed by the leaf spring 460 against the raised flat surface 428 of the first heat-conducting member 402 via the PET film 461. Heat generated in the drive IC 302 by the action of the first piezoelectric actuator row 220 is transferred to the raised flat surface 428. The heat is transferred to the second heat-conducting member 405 through a contact surface 481 between the first heat-conducting member 402 and the second heat-conducting member 405 and the screw 452, along the dashed-line arrow 480. With respect to the second piezoelectric actuator row 224, heat is also similarly transferred to the first heat-conducting member 403 and is then transferred to the second heat-conducting member 404 through a contact surface 483, along a dotted-line arrow 482.

A metal plate 462 causes the second heat-conducting member 405 and the stainless-steel cover 205 to have a same electric potential. A metal plate 447 causes the second heat-conducting member 404 and the stainless-steel cover 205 to have a same electric potential.

When being mounted in the inkjet printer 100, a plurality of inkjet heads 1A each corresponding to the above-described inkjet head 1A are arranged in a staggered manner. The arrangement in a staggered manner enables forming what is referred to as a line head. The printing width of the line head corresponds to the width of the recording medium S in the axial direction of the holding drum 105.

In the first embodiment, the material of the first heat-conducting members 402 and 403 is pure aluminum. The thermal conductivity of pure aluminum is 237 W/(m·° C.). Since the first heat-conducting members 402 and 403 are housed in the inkjet head 1A, the plate material thereof is made of pure aluminum having high thermal conductivity. Other materials such as copper (398 W/(m·° C.)) and silver (420 W/(m·° C.)) may also be used for the first heat-conducting members 402 and 403. Each of the second heat-conducting members 404 and 405 is made of die-cast aluminum so as to have the circular projections 440 and 441 at the inner surface thereof and to have projections for heat dissipation formed on the outer surface thereof. Alloys for die-cast aluminum have thermal conductivity in the range of 95 to 138 W/(m·° C.). Materials such as a zinc alloy (110 W/(m·° C.)) and a magnesium alloy (50 W/(m·° C.)) may also be used for die casting. The thermal conductivity of each of the first heat-conducting members 402 and 403 is set higher than the thermal conductivity of each of the second heat-conducting members 404 and 405. With this configuration, heat generated at the drive ICs 302 and 313 in a small space inside the inkjet head 1A can be efficiently transferred to the second heat-conducting members 404 and 405.

The heatproof temperature of a drive IC is 80° C. As mentioned above, six FETs are activated to eject an ink droplet from one pressure chamber communicating with one nozzle for ejection of ink droplets. When ink droplets are being sequentially ejected from 600 nozzles 240, 3,600 FETs are sequentially activated. The inkjet head 1A is further hermetically sealed. Due to the hermetical sealing, ink mist scattering in the inkjet printer 100 can be prevented from entering the inkjet head 1A. However, due to the hermetical sealing, heat generated in the inkjet head 1A may cause the drive ICs 302 and 313 to exceed the heatproof temperature thereof. When the heatproof temperature is exceeded, the drive IC may be damaged. According to the configuration of the first embodiment, heat generated at a drive IC can be efficiently dissipated, the drive IC can be prevented from being damaged. The "hermetical sealing" refers to a chassis serving as second heat-conducting members surrounds ink ejection portions, integrated circuits, circuit boards, and first heat-conducting members so as to avoid ink mist from entering an ink jet head.

Heat generated at the drive IC 302 or 312 is transferred to the first heat-conducting member 402 or 403 having high thermal conductivity, in the direction +Y and is then transferred to the second heat-conducting member 404 or 405, serving as a chassis. Thus, heat generated at the drive IC 302 or 312 can be prevented from heating ink via the manifold 201, the first ink supply tube 129, the first ink discharge tube 130, the second ink supply tube 131, and the second ink discharge tube 132. When ink temperature rises, the viscosity of ink decreases. Due to a decrease in ink viscosity, the amount of ejected ink increases even by a same change in the volume of a pressure chamber. When the amount of ejected ink changes, the density of a printed image also changes. According to the configuration of the first embodiment, such unintended change in an image density can be prevented or reduced.

The centers of the circular openings 343 and 344 are located on the lines passing through the centers of the drive ICs 302 and 313 in the Z-axis direction. As described above, the drive ICs 302 and 313 have a reed-shape that is long in the Z-axis direction and short in the X-axis direction. Since the centers of the circular openings 343 and 344 are located on the lines passing through the centers of the reed-shaped drive ICs 302 and 313, heat generated at the entire drive ICs 302 and 313 can be efficiently transferred to the first heat-conducting member. Since heat can be efficiently transferred to the first heat-conducting member, heat can be efficiently dissipated from the second heat-conducting member.

SECOND EMBODIMENT

Figure 12:
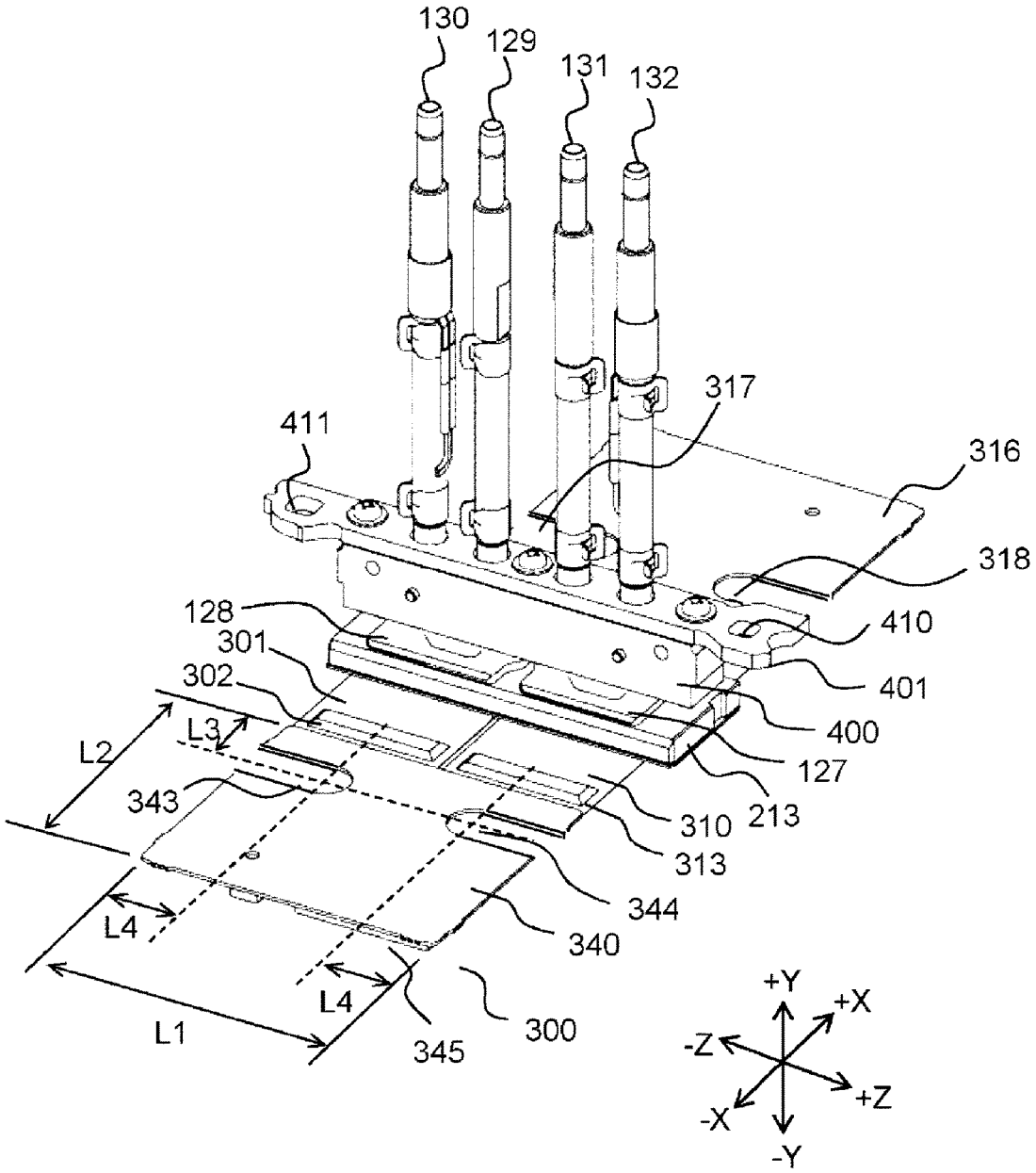
FIG. 12 is a development view of an ink ejection portion, an integrated circuit, and a circuit board mounted in an inkjet head according to a second embodiment.

FIG. 12 illustrates an inkjet head 1A according to a second embodiment. The shapes of the openings 317, 318, 343, and 344 formed in the printed-wiring boards 316 and 340 are different from those in the first embodiment. Configurations other than the difference in the shapes of the openings 4 are the same as in the first embodiment.

Each of the openings 343 and 344 according to the second embodiment has a shape including a semicircle with a diameter of 10 mm and a cutout with a width of 10 mm connecting to the semicircle and obtained by cutting the printed-wiring board 340 up to the end portion thereof in the Z-axis direction. If the shape of the projection of the second heat-conducting member 405 is made to match such a shape of the opening, the area of contact between the first heat-conducting member 402 and the second heat-conducting member 405 can be increased. The increase in contact area more facilitates heat dissipation. The openings 317 and 318 in the second embodiment has the same shape as that of the openings 343 and 344.

THIRD EMBODIMENT

Figure 13:
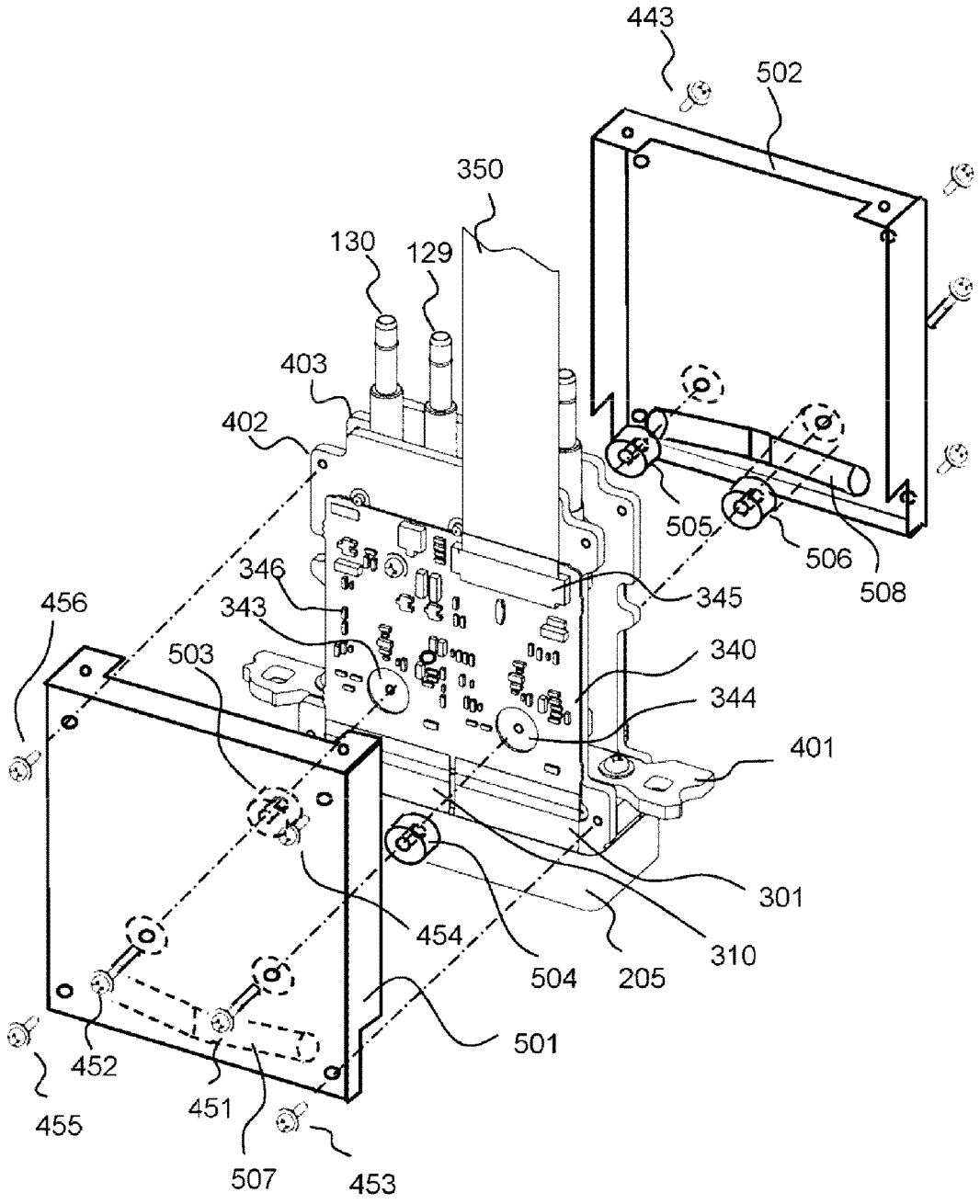
FIG. 13 is a diagram of second heat-conducting members mounted on an inkjet head according to a third embodiment.

FIG. 13 illustrates an inkjet head 1A according to a third embodiment. The configurations of second heat-conducting members 501 and 502 are different from those of the second heat-conducting members 404 and 405 according to the first embodiment. Configurations other than the difference in the second heat-conducting members 501 and 502 are the same as those of the inkjet head 1A in the first embodiment.

Each of the second heat-conducting members 501 and 502 is made of a plate material of pure aluminum with a thickness of 0.5 mm. The second heat-conducting member 501 is in contact with the first heat-conducting member 402 via circular heat-conducting elements 503 and 504. Each of the circular heat-conducting elements 503 and 504 is made of copper having high thermal conductivity. If each of the first heat-conducting member 402 and the second heat-conducting member 501 is made of pure aluminum plate, weight saving can be attained. The second heat-conducting member 502 is in contact with the first heat-conducting member 403 via circular heat-conducting elements 505 and 506. Each of the circular heat-conducting elements 505 and 506 is also made of copper.

In the description of the above example embodiments, an inkjet head is described as an example. In some embodiments, a liquid jetting device including an inkjet head, such as a liquid dispensing apparatus or a liquid resin jetting device of a 3D printer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid jetting device, comprising:

a plurality of nozzles from which a liquid can be ejected;

a plurality of pressure chambers, each pressure chamber being in fluid communication with an associated nozzle in the plurality of nozzles;

actuators associated with each pressure chamber and configured to cause a pressure change in an associated pressure chamber in the plurality of pressure chambers;

a chassis to which the plurality of nozzles, the plurality of pressure chambers, and the actuators are mounted, the chassis including a projecting portion on an inner surface;

an integrated circuit inside the chassis and configured to drive the actuators to eject liquid from the plurality of nozzles;

a circuit board inside the chassis, electrically connected to the integrated circuit, and configured supply an electrical signal to the integrated circuit; and a support to which the circuit board is mounted, the support being held by the chassis and contacting the integrated circuit and the inner surface of the chassis, wherein the circuit board includes an opening and the projecting portion of the chassis extends through the opening to contact the support.

2. The liquid jetting device according to claim 1, wherein the opening in the circuit board is a semicircle connected to a cutout extending from an outer edge of the circuit board to the semicircle.

3. The liquid jetting device according to claim 1, wherein a length of the integrated circuit in a first direction along a line in which the plurality of nozzles are arrayed is longer than a length of the integrated circuit in a second direction perpendicular to the first direction, and the opening of the circuit board is located on a line which passes through a center of the integrated circuit in the first direction and extends in the second direction.

4. The liquid jetting device according to claim 1, wherein the integrated circuit is in contact with the support via an electrical insulating film.

5. The liquid jetting device according to claim 1, wherein the chassis has a first thermal conductivity, and a heat conductivity of the support is greater than the first thermal conductivity.

6. The liquid jetting device according to claim 5, wherein the support is formed with one of aluminum, copper, and silver, and the chassis is formed with one of an aluminum alloy, a zinc alloy, and a magnesium alloy.

7. The liquid jetting device according to claim 1, wherein the integrated circuit is disposed on a polyimide film.

8. The liquid jetting device according to claim 1, wherein the chassis hermetically seals the integrated circuit, the circuit board, the support, and electrical connections between the integrated circuit and the actuators.

9. A liquid jetting device, comprising:

a plurality of nozzles from which a liquid can be ejected;

a plurality of pressure chambers, each pressure chamber being in fluid communication with an associated nozzle in the plurality of nozzles;

actuators associated with each pressure chamber and configured to cause a pressure change in an associated pressure chamber in the plurality of pressure chambers;

a chassis to which the plurality of nozzles, the plurality of pressure chambers, and the actuators are mounted, the chassis including a projection portion on an inner surface;

an integrated circuit inside the chassis and configured to drive the actuators to eject liquid from the plurality of nozzles;

a circuit board inside the chassis, electrically connected to the integrated circuit, and configured supply an electrical signal to the integrated circuit;

a support to which the circuit board is mounted, the support being held by the chassis and contacting the integrated circuit and the inner surface of the chassis;

a plurality of ink supply ports, each ink supply port supplying ink to one pressure chamber in the plurality of pressure chambers; and a plurality of ink discharge ports, each ink discharge port collecting liquid remaining in one nozzle in the plurality of nozzles and re-supplying the liquid to the corresponding pressure chamber, wherein the circuit board includes an opening and the projecting portion of the chassis extends through the opening to contact the support.

10. The liquid jetting device according to claim 9, wherein the opening in the circuit board is a semicircle connected to a cutout extending from an outer edge of the circuit board to the semicircle.

11. The liquid jetting device according to claim 9, wherein a length of the integrated circuit in a first direction along a line in which the plurality of nozzles are arrayed is longer than a length of the integrated circuit in a second direction perpendicular to the first direction, and the opening of the circuit board is located on a line which passes through a center of the integrated circuit in the first direction and extends in the second direction.

12. The liquid jetting device according to claim 9, wherein the integrated circuit is in contact with the support via an electrical insulating film.

13. The liquid jetting device according to claim 9, wherein the chassis has a first thermal conductivity, and a heat conductivity of the support is greater than the first thermal conductivity.

14. A liquid dispensing apparatus, comprising:

a plurality of nozzles from which a liquid can be ejected;

a plurality of pressure chambers, each pressure chamber being in fluid communication with an associated nozzle in the plurality of nozzles;

actuators associated with each pressure chamber and configured to cause a pressure change in an associated pressure chamber in the plurality of pressure chambers;

a chassis to which the plurality of nozzles, the plurality of pressure chambers, and the actuators are mounted, the chassis including a projecting portion on an inner surface;

an integrated circuit inside the chassis and configured to drive the actuators to eject liquid from the plurality of nozzles;

a circuit board inside the chassis, electrically connected to the integrated circuit, and configured supply an electrical signal to the integrated circuit;

a support to which the circuit board is mounted, the support being held by the chassis and contacting the integrated circuit and the inner surface of the chassis;

a plurality of ink supply ports, each ink supply port supplying ink to one pressure chamber in the plurality of pressure chambers;

a plurality of ink discharge ports, each ink discharge port collecting liquid remaining in one nozzle in the plurality of nozzles and re-supplying the liquid to the corresponding pressure chamber; and a conveyance device configured to convey a recording medium on which ink is ejected, wherein the circuit board includes an opening and the projecting portion of the chassis extends through the opening to contact the support.

15. The liquid dispensing apparatus according to claim 14, wherein a length of the integrated circuit in a first direction along a line in which the plurality of nozzles are arrayed is longer than a length of the integrated circuit in a second direction perpendicular to the first direction, and the opening of the circuit board is located on a line which passes through a center of the integrated circuit in the first direction and extends in the second direction.

16. The liquid dispensing apparatus according to claim 14, wherein the integrated circuit is in contact with the support via an electrical insulating film.

17. The liquid dispensing apparatus according to claim 14, wherein the chassis has a first thermal conductivity, and a heat conductivity of the support is greater than the first thermal conductivity.

18. The liquid jetting device according to claim 1, wherein the chassis comprises die-cast aluminum, and the support comprises aluminum.

19. The liquid jetting device according to claim 9, wherein the chassis comprises die-cast aluminum, and the support comprises aluminum.

20. The liquid dispensing apparatus according to claim 14, wherein the chassis comprises die-cast aluminum, and the support comprises aluminum.

* * * * *